US009784086B2

(12) United States Patent
Zhao

(10) Patent No.: US 9,784,086 B2
(45) Date of Patent: Oct. 10, 2017

(54) METHOD AND PROCESS FOR EXTRACTING SHALE OIL AND GAS BY FRACTURING AND CHEMICAL RETORTING IN OIL SHALE IN-SITU HORIZONTAL WELL

(71) Applicants: JILIN ZHONGCHENG OIL SHALE INVESTMENT AND DEVELOPMENT CO. LTD., Changchun, Jilin (CN); Jinmin Zhao, Changchun, Jilin (CN)

(72) Inventor: Jinmin Zhao, Jilin (CN)

(73) Assignees: Jilin Zhongcheng Oil Shale Investment and Development Co., Ltd., Changchun (CN); Jinmin Zhao, Changchun (CN)

( * ) Notice: Subject to any disclaimer, the term of this patent is extended or adjusted under 35 U.S.C. 154(b) by 57 days.

(21) Appl. No.: 14/787,708

(22) PCT Filed: May 4, 2014

(86) PCT No.: PCT/CN2014/000460

§ 371 (c)(1),
(2) Date: Oct. 28, 2015

(87) PCT Pub. No.: WO2014/176933

PCT Pub. Date: Nov. 6, 2014

(65) Prior Publication Data

US 2016/0076350 A1 Mar. 17, 2016

(30) Foreign Application Priority Data

Apr. 28, 2013 (CN) ..... 2013 1 0152389

(51) Int. Cl.
*E21B 43/26* (2006.01)
*E21B 43/24* (2006.01)
(Continued)

(52) U.S. Cl.
CPC ..... *E21B 43/26* (2013.01); *E21B 7/046* (2013.01); *E21B 43/114* (2013.01);
(Continued)

(58) Field of Classification Search
CPC ..... E21B 43/2401; E21B 43/24; E21B 36/04; E21B 43/243; E21B 43/305;
(Continued)

(56) References Cited

U.S. PATENT DOCUMENTS 8,151,907 B2 * 4/2012 MacDonald ..... C10G 21/22 175/26
2007/0095536 A1 * 5/2007 Vinegar ..... C10G 1/002 166/302

FOREIGN PATENT DOCUMENTS

CN 2550496 Y 5/2003
CN 20 13 67892 Y 12/2009
(Continued)

*Primary Examiner* — Zakiya W Bates
(74) *Attorney, Agent, or Firm* — Knobbe, Martens, Olson & Bear, LLP

(57) ABSTRACT

Disclosed is a method for extracting shale oil and gas by fracturing, and chemical retorting in oil shale in-situ horizontal well and a process for implementing the method. In the method and process, an inclined well is drilled from the ground to the upper part of an underground oil shale stratum, and a horizontal well is drilled in parallel to the oil shale stratum in the upper part of the oil shale stratum. Behind the horizontal well and the inclined well in the upper part, an inclined well leading to the lower part of the oil shale stratum is drilled, and a horizontal well is drilled in parallel to the lower part of the oil shale stratum. Highly pressurized media are injected into the horizontal well in the upper part of the oil shale stratum.

6 Claims, 2 Drawing Sheets

(51) Int. Cl.

| | |
|---|---|
| ***E21B 43/247*** | (2006.01) |
| ***E21B 7/04*** | (2006.01) |
| ***E21B 43/114*** | (2006.01) |
| ***E21B 43/267*** | (2006.01) |

(52) U.S. Cl.
CPC ..... *E21B 43/2405* (2013.01); *E21B 43/247* (2013.01); *E21B 43/267* (2013.01)

(58) Field of Classification Search
CPC ..... E21B 43/281; E21B 43/16; E21B 43/168; E21B 43/30; E21B 36/02; E21B 43/247; E21B 43/2405; E21B 36/00; E21B 43/166
See application file for complete search history.

(56) References Cited

FOREIGN PATENT DOCUMENTS

| | | | |
|---|---|---|---|
| CN | 10 2444397 | A | 5/2012 |
| CN | 10 3232852 | A | 8/2013 |
| CN | 10 3233713 | A | 8/2013 |
| CN | 20 3499663 | U | 3/2014 |
| CN | 20 3499664 | U | 3/2014 |
| WO | WO 2011/143053 | A1 | 11/2011 |

* cited by examiner

METHOD AND PROCESS FOR EXTRACTING SHALE OIL AND GAS BY FRACTURING AND CHEMICAL RETORTING IN OIL SHALE IN-SITU HORIZONTAL WELL

BACKGROUND

Technical Field

The present invention discloses a method and a process for extracting shale oil and gas by fracturing and chemical retorting in oil shale in-situ horizontal well, in which shale oil is extracted in in-situ underground oil shale and is served as unconventional oil and gas energy for making up shortage of petroleum resources, and which belong to a technical field of retorting of petroleum.

Description of the Related Art

At present, shale oil (artificial petroleum), which is used to substitute for naturally occurring petroleum, may be refined from shale oil by virtue of retorting technology, and is also used for electricity generation by utilizing combustion thereof. Under the current situation that price of the oil keeps high, shale oil refining has good economic benefits and is a most realistic available measure to make up shortage of naturally occurring petroleum. Electricity generation by oil shale has good economic, environmental and social benefits to these provinces and districts which encounter shortage of coals. However, production and development of shale oil always adopts conventional method of underground exploitation and on-ground retorting, which encounters lots of shortcomings.

1). The on-ground retorting has large excavation cost.

2). The on-ground retorting needs large land-use footprint.

3). The on-ground retorting leads to a great deal of landslide in exploration area.

4). The tailings resulted from the on-ground retorting are difficult to be treated, and its bulk accumulation causes secondary pollution.

5). The tailings resulted from the on-ground retorting carry away lots of heat so that heat from the tailings is unavailable, which results in energy waste.

6). Waste gas and sewage obtained from the on-ground retorting causes excessive pollution of the environment.

SUMMARY

The present invention discloses a method and a process for extracting shale oil and gas by fracturing and chemical retorting in oil shale in-situ horizontal well, which fundamentally solve the abovementioned shortcomings and problems caused by underground exploitation and on-ground retorting.

The following is a technical solution of a method for extracting shale oil and gas by fracturing and chemical retorting in oil shale in-situ horizontal well disclosed in the present invention.

The method comprises:

drilling an inclined well from the ground to an upper part of an underground oil shale stratum, and, drilling a horizontal well in parallel to the oil shale stratum in the upper part of the oil shale stratum; behind the horizontal well and the inclined well in the upper part, drilling an inclined well leading to a lower part of the oil shale stratum, and, drilling a horizontal well in parallel to the lower part of the oil shale stratum; injecting a highly pressurized medium (air, water and quartz sand) into the horizontal well in the upper part of oil shale stratum, and fracturing out cracks of 1 to 3 mm in the oil shale stratum surrounding the horizontal well in the upper part of the oil shale stratum as a center, the cracks being filed with gap supporting (quartz sand), so as to establish oil gas passages connected to the horizontal well in the lower part; adding a heating apparatus into the horizontal well in the upper part of the oil shale stratum, heating the oil shale stratum to 550-600° C., initially retorting the oil shale, driving and extracting shale oil and gas, and leading the shale oil and gas out of the ground from the horizontal well in the lower part of the oil shale stratum via the oil gas passages; introducing an oxidant through the horizontal well in the upper part of the oil shale stratum, for oxidization reaction with asphaltenes and fixed carbon remained in the oil shale after being retorted, where the heat generated is used as a heat source for subsequent retorting, thereby achieving extraction of the shale oil and gas by underground in-situ retorting of the oil shale; separating the shale oil and gas by a ground gas-liquid separator, and delivering the separated shale oil to a product tank for storage and sale; and, delivering obtained combustible gas to a gas power package for power generation.

A process for implementing the mentioned method of extracting shale oil and gas by fracturing and chemical retorting in oil shale in-situ horizontal well according to the present invention is disclosed. The process comprising the following steps of:

1). depending on distribution and strike and embedment conditions of an oil shale stratum, drilling an inclined well from the ground to an upper part of an underground oil shale stratum, and, drilling a horizontal well in parallel to the oil shale stratum in the upper part of the oil shale stratum, that is, a fractured burning well;

2). behind the fractured burning well, drilling several inclined wells leading from the ground to a lower part of the oil shale stratum, wherein the inclined wells should penetrate through the oil shale stratum, and, drilling several horizontal wells in parallel to the lower part of the oil shale stratum, which are export production wells;

3). establishing a fracturing chamber within the fractured burning well, taking out a well casing, injecting a highly pressurized medium into the oil shale stratum through the fractured burning well, pressurizedly fracturing out several cracks of 1 to 3 mm in the oil shale stratum, and filling the cracks with gap supporting (quartz sand), so as to establish oil gas passages; wherein the step 2) further comprises:

i). drifting and flushing the well;

ii). running a hydraulic casing nozzle into a wellbore;

iii). closing the casing and shale wall gaps to form a closed fracturing space;

iv). implementing a hydraulic jet perforation, by the hydraulic casing nozzle, on the oil shale stratum, wherein a mortar containing base fluid (water) and sand-laden fluid at 20-35% is pumped at a cutting stage, and, when the sand-laden fluid is distanced from the nozzle at about 250 meters, sharply increasing pump speed to ensure that sufficient pressure different (55-80 MPa) which is required to implement the hydraulic jet perforation is obtained;

v). replacing fracture rocks from the perforation, after 2-3 minutes of operation of the hydraulic jet perforation;

vi). pumping carbamidine gel base fluid via an annular bore, in accordance with a design annular bore discharge capacity or at a maximum pump speed allowed by an maximum pressure of the annular bore, and, pumping cross-linked gel and sand (at a rate of 20-30:40-60), in accordance with a design of an oil pipe, to enhance an expansion strength;

vii). discharging fluid after fracturing, and flushing the sand to support the cracks;

viii). injecting a fluid temporary plugging agent into the wellbore;

vi). lifting up a drilling tool to a designed position, to fracture a next stratum, and repeating the steps iii). to vi).;

3). establishing a fracturing chamber within the fractured burning well; wherein the step 3) further comprises:

i). flushing the well, to bring the sand-contained water out of the fractured burning well onto the ground;

ii). equipping a sealing casing onto a head of the fractured burning well and running the sealing casing till 0.5 meter under the oil shale stratum, and, closing the casing and the shale wall gaps by means of an expansion agent;

iii). equipping combustible gas and air introducing pipes and an electronic ignition system within the fractured burning well, and, closing the head, to form a burning chamber in a segment of the oil shale stratum;

iv). delivering LPG and air into the burning chamber via a combustible gas delivery pipe, and, igniting the combustible gas by the electronic ignition system;

v). heating the oil shale stratum to 550-600° C. after igniting the oil shale, stopping supply of the combustible gas when it is measured that temperature of the gas from the production well reaches 200° C. and, driving and extracting some of the shale oil and gas to a ground gas-liquid separator via oil gas passages and the export production wells;

4). continuing to inject highly pressurized air into the well, for oxidization reaction with asphaltenes and fixed carbon remained in the oil shale after being retorted, under high temperature, so as to generate fresh combustible gas while driving and extracting the shale oil and gas to the ground via the oil gas passages and the export production wells;

5). separating the exported shale oil and gas by the ground gas-liquid separator, and delivering the separated shale oil to a product tank for storage; and, 6). delivering the separated combustible gas, via the gas-liquid separator, to a gas power package for power generation.

The hydraulic casing nozzle mainly comprises an upper centralizer, an ejection gun, a check valve, a lower centralizer, a screen pipe and a guide shoe, wherein a surface of the ejection gun is provided with an ejection nozzle, the ejection nozzle has one end communicated with the casing by a nipple and the other end communicated with the screen pipe by the check valve, an outside of the nipple is cased with the upper centralizer, pipe wall of the screen pipe is uniformly distributed with several screen meshes, the lower centralizer is cased over the screen pipe, and, the guide shoe is secured to a top of the screen pipe.

The present invention has the following positive effects.

Firstly, the oil shale is fractured and the shale oil is extracted in in-situ underground oil shale, which avoids bulk exploitation of oil shale mine and averts environmental pollution brought by on-ground refining. Secondly, underground continuous retorting is achieved by utilizing asphaltenes and fixed carbon remained in the oil shale after being retorted, accordingly, the heat is self-sufficient. Thirdly, the chemical heat treatment process is neither a single physical heating process nor an underground spontaneous combustion process, pores in the rock are gradually increased during the course of reaction, and, it is suitable for most oil shale strata. Fourthly, a layout that the fractured burning well and the export production wells in the oil shale stratum is parallel to the oil shale stratum is adopted, so that contact areas between the fractured burning well and the export production wells and the oil shale stratum are increased, and the retorting capability is enhanced. The present invention has advantages of small investments, low operating costs, small environmental pollutions, high resource utilization rate, and fast yields of oil and gas, etc.

in which:

1. fractured burning well, 2. export production well, 3. gas-liquid separator, 4. product tank, 5. gas power package, 6. oil shale stratum, 7. other stratum, 8. oil gas passage, 9. material conveyor, 10. discharge and transport machine, 11. oil pump, 12. crack, 13. fracturing fluid tank, 14. LPG storage tank, 15. oxidant tank, 16. upper centralizer, 17. ejection gun, 18. ejection nozzle, 19. check valve, 20. lower centralizer, 21. screen pipe, 22. guide shoe, 23. casing, and, 24. nipple.

DETAILED DESCRIPTION OF THE EMBODIMENTS

In order to provide a much clearer understanding of essences and characteristics of the present invention, implementation and positive effects of the present invention will be described hereinafter in detail in conjunction with these embodiments. It should be understood that the below description is not intended to limit the scope of the present invention.

Embodiment 1

Fuyu-Sanjunxiang Oil Shale Mine is taken as an implementation base, and, Fuyu-Changchun Mountain Oil Shale has a total reserves is of 45.274 billion tons. The oil shale has an average grade of 5.53%, a total industrially developable resources amount of 18 billions, an embedded depth of 160-800 meters with top and bottom strata of mousey shale, and an average thickness of 5 meters.

Figure 1:
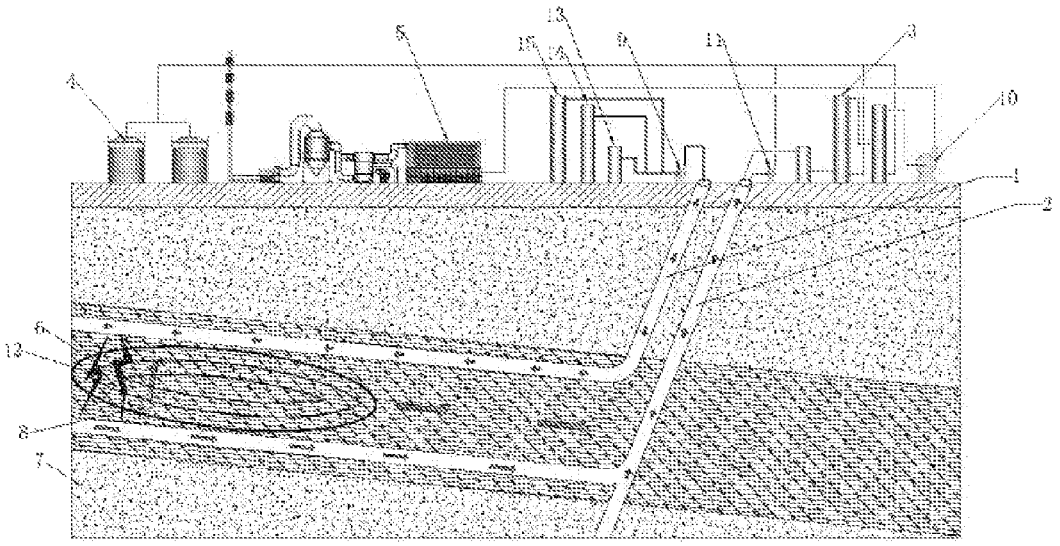
FIG. 1 is a principle diagram of a method for extracting shale oil and gas by fracturing and chemical retorting in oil shale in-situ horizontal well according to the present invention.

As shown in FIG. 1, depending on distribution and strike and embedment conditions of an oil shale stratum, drilling an inclined well from the ground to an upper part of an underground oil shale stratum 6, and, drilling a horizontal well in parallel to the oil shale stratum 6 in the upper part of the oil shale stratum 6, that is, a fractured burning well 1 (a head of which has a diameter of 200 mm).

Figure 2:
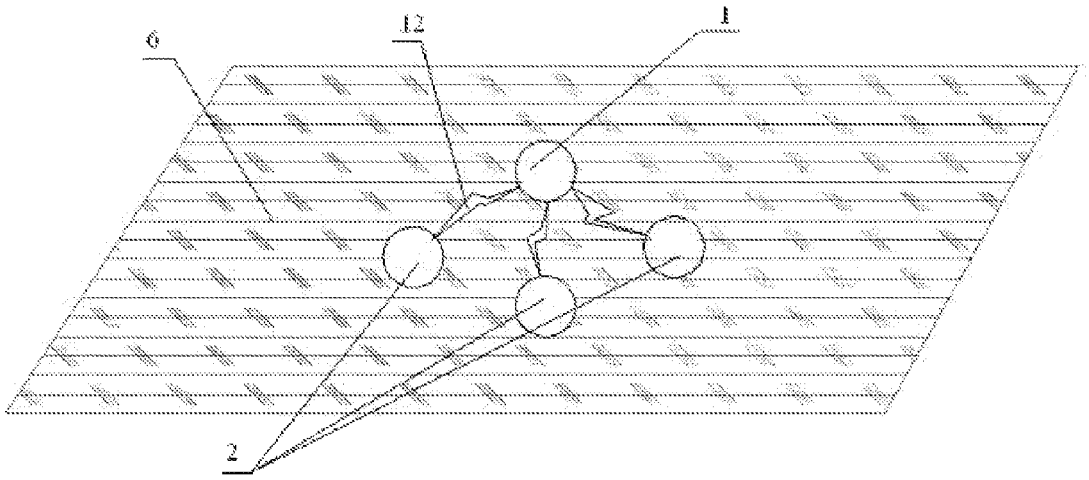
FIG. 2 is a schematic structural diagram of distribution of horizontal wells according to the present invention.

Behind the fractured burning well 1, drilling several inclined wells leading from the ground to a lower part of the oil shale stratum 6, in which the inclined wells should penetrate through the oil shale stratum 6, and, drilling several horizontal wells in parallel to the lower part of the oil shale stratum 6, which are export production wells (a head of each of which has a diameter of 200 mm). As shown in FIG. 2, the six export production wells 2 are distributed in a honeycombed manner surrounding the fractured burning well 1 as a center. The fractured burning well 1 and the export production wells 2 are drilled from the ground to the underground oil shale stratum 6, wherein the export production wells 2 should penetrate through the oil shale stratum 6, and, the export production wells 2 are distributed in a umbrella-shaped manner surrounding the fractured burning well 1 as a center.

2). A fracturing chamber is established within the fractured burning well, a well casing is taken out, a highly pressurized medium is injected into the oil shale stratum through the fractured burning well, several cracks of 1 to 3 mm are fractured out in the oil shale stratum, and the cracks are filled with gap supporting quartz sand, so as to establish oil gas passages.

The step 2) further comprises:

i). drifting and flushing the well;

ii). running a hydraulic casing nozzle into a wellbore;

iii). closing the casing and shale wall gaps to allow the oil shale stratum to form a closed fracturing space;

iv). implementing a hydraulic jet perforation, by the hydraulic casing nozzle, on the oil shale stratum 6 in the fractured burning well, wherein a mortar containing base fluid (water) and sand-laden fluid (at 20-35%) is injected from the fracturing fluid tank into the oil shale stratum 6 by a material conveyor 9 (at a cutting stage), and, when the sand-laden fluid is distanced from the nozzle at about 250 meters, sharply increasing pump speed to ensure that sufficient pressure different (55-80 MPa) which is required to implement the hydraulic jet perforation is obtained to pressurizedly fracture the oil shale stratum 6 to generate cracks 12 of 1-3 mm;

v). replacing fracture rocks from the perforation, after 2-3 minutes of operation of the hydraulic jet perforation;

vi). pumping carbamidine gel base fluid by an annular bore, in accordance with a design annular bore discharge capacity or at a maximum pump speed allowed by an maximum pressure of the annular bore, and, pumping cross-linked asphaltenes gel and sand, in accordance with a design of an oil pipe, to enhance an expansion strength;

vii). discharging fluid after fracturing, wherein the quartz sand is remained to support the cracks, so that a plurality of oil gas passages 8 are converged and communicated with the export production wells 2;

viii). injecting a fluid temporary plugging agent into the wellbore;

iv). lifting up a drilling tool to a designed position, and continuing the fracturing process on the upper part of the oil shale, repeating the steps until the oil shale stratum have been completely fractured out.

3). A fracturing chamber is established within the fractured burning well. The step 3) further comprises:

a first step of, flushing the well, to bring the sand-contained water out of the well onto the ground;

a second step of, equipping a sealing casing onto a head of the fractured burning well and running the sealing casing till 0.5 meter under the oil shale stratum, and, closing the casing and the shale wall gaps by means of an expansion agent;

a third step of, equipping combustible gas and air introducing pipes and an electronic ignition system within the fractured burning well, and, closing the head, to form a burning chamber in a segment of the oil shale stratum;

a fourth step of, delivering LPG and air from a LPG storage tank 14 and an oxidant tank 15 through the fractured burning well 1 into the oil shale stratum 6 by a material conveyor 9, and, igniting the combustible gas by the electronic ignition system;

a sixth step of, heating the oil shale stratum 6 to 550-600° C. after igniting the oil shale, stopping supply of the combustible gas when it is measured that temperature of the gas from the production well 2 reaches 200° C. and, driving some of the shale oil and gas to a ground gas-liquid separator 3 via oil gas passages 8 and the export production wells 2;

4). continuing to inject highly pressurized air (the air: 1000 $m^3$ per hour) from the oxidant tank 15 into the fractured burning well 1 by a material conveyor 9, for oxidization reaction with asphaltenes and fixed carbon remained in the oil shale 6 after being retorted, under high temperature, so as to generate fresh combustible gas (while driving the shale oil and gas) to the gas-liquid separator 3 via the oil gas passages 8 and the export production wells 2, so that the underground in-situ extraction of the shale oil and gas is achieved;

5). separating the exported shale oil and gas by the ground gas-liquid separator 3, and delivering the separated shale oil to a product tank 4 for storage and sale, by an oil pump; and, 6). delivering the separated combustible gas, via the gas-liquid separator 3, to a gas power package 5 for power generation, by a discharge machine 10.

Embodiment 2

Nongan Oil Shale Mine, in which a total mining area is of 675.5 $km^2$, the total resources is of 6.172 billion tons and the total exploitable resources is of 4.94 billion tons, is taken as an implementation base. The oil shale has an average grade of 5%, an embedded depth of 160-800 meters with top and bottom strata of mousey shale, and an average thickness of 6 meters.

1). As shown in FIG. 1, depending on distribution and strike and embedment conditions of an oil shale stratum, drilling an inclined well from the ground to an upper part of an underground oil shale stratum 6, and, drilling a horizontal well in parallel to the oil shale stratum 6 in the upper part of the oil shale stratum 6, that is, a fractured burning well 1 (a head of which has a diameter of 200 mm).

Behind the fractured burning well 1, drilling several inclined wells leading from the ground to a lower part of the oil shale stratum 6, wherein the inclined wells should penetrate through the oil shale stratum 6, and, drilling several horizontal wells in parallel to the lower part of the oil shale stratum 6, which are export production wells (a head of each of which has a diameter of 200 mm). As shown in FIG. 2, the six export production wells 2 are distributed in a honeycombed manner surrounding the fractured burning well 1 as a center. The fractured burning well 1 and the export production wells 2 are drilled from the ground to the underground oil shale stratum 6, wherein the export production wells 2 should penetrate through the oil shale stratum, and, the export production wells 2 are distributed in a umbrella-shaped manner surrounding the fractured burning well 1 as a center.

2). A fracturing chamber is established within the fractured burning well, a well casing is taken out, a highly pressurized medium is injected into the oil shale stratum through the fractured burning well, several cracks of 1 to 3 mm are fractured out in the oil shale stratum, and the cracks are filled with gap supporting quartz sand, so as to establish oil gas passages. The step 2) further comprises:

i). drifting and flushing the well;

ii). running a hydraulic casing nozzle into a wellbore;

iii). closing the casing and shale wall gaps to allow the oil shale stratum to form a closed fracturing space;

iv). implementing a hydraulic jet perforation in the fractured burning well, wherein a mortar containing base fluid (water) and sand-laden fluid (at 20-35%) is injected from the fracturing fluid tank into the oil shale stratum 6 by a material conveyor 9 (at a cutting stage), and, when the sand-laden fluid is distanced from the nozzle at about 250 meters, sharply increasing pump speed to ensure that sufficient pressure different (55-80 MPa) which is required to implement the hydraulic jet perforation is obtained to pressurizedly fracture the oil shale stratum 6 to generate cracks 12 of 1-3 mm;

v). replacing fracture rocks from the perforation, after 2-3 minutes of operation of the hydraulic jet perforation;

vi). pumping carbamidine gel base fluid by an annular bore, in accordance with a design annular bore discharge capacity or at a maximum pump speed allowed by an maximum pressure of the annular bore, and, pumping cross-linked asphaltenes gel and sand, in accordance with a design of an oil pipe, to enhance an expansion strength;

vii). discharging fluid after fracturing, wherein the quartz sand is remained to support the cracks, so that a plurality of oil gas passages 8 are converged and communicated with the export production wells 2;

viii). injecting fluid temporary plugging agent into the wellbore;

iv). lifting up a drilling tool to a designed position, and continuing the fracturing process on the upper part of the oil shale, repeating the steps until the oil shale stratum have been completely fractured out.

3). A fracturing chamber is established within the fractured burning well. The step 3) further comprises:

a first step of, flushing the well, to bring the sand-contained water out of the well onto the ground;

a second step of, equipping a sealing casing onto a head of the fractured burning well and running the sealing casing till 0.5 meter under the oil shale stratum, and, closing the casing and the shale wall gaps by means of an expansion agent;

a third step of, equipping combustible gas and air introducing pipes and an electronic ignition system within the fractured burning well, and, closing the head, to form a burning chamber in a segment of the oil shale stratum;

a fourth step of, delivering LPG and air from a LPG storage tank 14 and an oxidant tank 15 through the fractured burning well 1 into the oil shale stratum 6 by a material conveyor 9, and, igniting the combustible gas by the electronic ignition system; and a sixth step of, heating the oil shale stratum 6 to 550-600° C. after igniting the oil shale, stopping supply of the combustible gas when it is measured that temperature of the gas from the production well 2 reaches 200° C. and, driving and extracting some of the shale oil and gas to a ground gas-liquid separator 3 via the oil gas passages 8 and the export production wells 2.

An oxidant is introduced into the oil shale stratum 6 for oxidization reaction with asphaltenes and fixed carbon remained in the oil shale after being retorted, where the heat generated is used as a heat source for subsequent retorting the subsequent oil shale progressively, wherein the generated shale oil and gas are passed through.

4). Highly pressurized air (the air: 1000 $m^3$ per hour) is continued to be injected from the oxidant tank 15 into the fractured burning well 1 by a material conveyor 9, for oxidization reaction with asphaltenes and fixed carbon remained in the oil shale 6 after being retorted, under high temperature, so as to generate fresh combustible gas (while driving the shale oil and gas) to the gas-liquid separator 3 via the oil gas passages 8 and the export production wells 2, so that the underground in-situ extraction of the shale oil and gas is achieved.

5). The exported shale oil and gas are separated by the ground gas-liquid separator 3, and delivering the separated shale oil to a product tank 4 for storage and sale, by an oil pump.

6). The separated combustible gas is delivered, via the gas-liquid separator 3, to a gas power package 5 for power generation, by a discharge machine 10.

Embodiment 3

Figure 3:
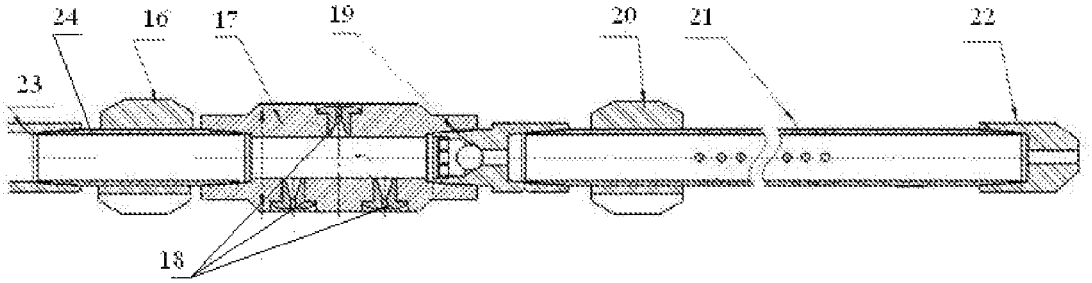
FIG. 3 is a structural principle diagram of a hydraulic casing nozzle according to the present invention.

Referring to FIG. 3, there discloses a hydraulic casing nozzle involved in embodiments 1 and 2, it mainly comprises an upper centralizer 16, an ejection gun 17, a check valve 19, a lower centralizer 20, a screen pipe 22, a guide shoe 23, a casing 23 and a nipple 24, wherein a surface of the ejection gun 17 is provided with an ejection nozzle 18, the ejection nozzle 17 has one end communicated with the casing 23 by a nipple 24 and the other end communicated with the screen pipe 21 by the check valve 19, an outside of the nipple 24 is cased with the upper centralizer 16, pipe wall of the screen pipe 21 is uniformly distributed with several screen meshes, the lower centralizer 20 is cased over the screen pipe 21, and, the guide shoe 22 is secured to a top of the screen pipe 21.

What is claimed is:

1. A process for implementing a method of extracting shale oil and gas by fracturing and chemical retorting in oil shale in-situ horizontal well, the method comprising:

drilling a first inclined well from the ground to an upper part of an underground oil shale stratum, drilling a horizontal well in parallel to the oil shale stratum in the upper part of the oil shale stratum;

drilling a second inclined well, behind the horizontal well and the first inclined well in the upper part, leading to a lower part of the oil shale stratum, and drilling a horizontal well in parallel to the lower part of the oil shale stratum;

injecting a highly pressurized medium comprising air, water and a gap filler into the horizontal well in the upper part of oil shale stratum, and fracturing out cracks of 1 to 3 mm in the oil shale stratum surrounding the horizontal well in the upper part of the oil shale stratum as a center, the cracks being filed with the gap filler, so as to establish oil gas passages connected to the horizontal well in the lower part;

adding a heating apparatus into the horizontal well in the upper part of the oil shale stratum, heating the oil shale stratum to 550-600° C., initially retorting the oil shale; and driving and extracting shale oil and gas, and leading the shale oil and gas out of the ground from the horizontal well in the lower part of the oil shale stratum via the oil gas passages, thereby achieving extraction of the shale oil and gas by underground in-situ retorting of the oil shale, wherein the process comprising:

1) drilling the first inclined well from the ground to the upper part of the underground oil shale stratum and drilling the horizontal well in parallel to the oil shale stratum in the upper part of the oil shale stratum, wherein the horizontal well is a fractured burning well;

2) drilling behind the fractured burning well several inclined wells leading from the ground to the lower part of the oil shale stratum, wherein the inclined wells penetrate through the oil shale stratum, and drilling several horizontal wells in parallel to the lower part of the oil shale stratum, which are export production wells;

3) establishing a fracturing chamber within a horizontal segment of the fractured burning well, taking out a well casing, injecting the highly pressurized medium into the oil shale stratum through the fractured burning well, pressurizedly fracturing out several cracks of 1 to 3 mm in the oil shale stratum, and filling the cracks with the gap filler, so as to establish oil gas passages; wherein the step 3) further comprises:

i) drifting and flushing the well;

ii) running a hydraulic casing nozzle into a wellbore;

iii) closing the casing and shale wall gaps to form a closed fracturing space;

iv) implementing a hydraulic jet perforation, wherein a mortar containing base fluid (water) and sand-laden fluid (at 20-35%) is pumped (at a cutting stage), and, when the sand-laden fluid is distanced from the nozzle at about 250 meters, sharply increasing pump speed to produce a sufficient pressure difference to implement the hydraulic jet perforation;

v) replacing fracture rocks from the perforation, after 2-3 minutes of operation of the hydraulic jet perforation;

vi) pumping carbamidine gel base fluid via an annular bore, in accordance with a design annular bore discharge capacity or at a maximum pump speed allowed by an maximum pressure of the annular bore, and, pumping crosslinked asphaltenes gel and sand (at a rate of 20-30: 40-60), in accordance with a design of an oil pipe, to enhance an expansion strength;

vii) discharging fluid after fracturing, and flushing the sand to support the cracks;

viii) injecting a fluid temporary plugging agent into the wellbore;

iv) lifting up a drilling tool to a designed position, to fracture a next stratum, and repeating the steps iii) to vi);

4) establishing a fracturing chamber within the fractured burning well; wherein the step 4) further comprises:

i) flushing the well, to bring the sand-containing water out of the fractured burning well onto the ground;

ii) equipping a sealing casing onto a head of the fractured burning well and running the sealing casing until 0.5 meter below the oil shale stratum, and, closing the casing and the shale wall gaps by means of an expansion agent;

iii) introducing combustible gas and air introducing pipes and an electronic ignition system within the fractured burning well, and, closing the head, to form a burning chamber in a segment of the oil shale stratum;

iv) delivering liquid petroleum gas (LPG) and air into the burning chamber via a combustible gas delivery pipe, and, igniting the combustible gas by the electronic ignition system;

v) heating the oil shale stratum to 550-600° C. after igniting the oil shale, stopping supply of the combustible gas when it is measured that temperature of the gas from the production well reaches 200° C. and, driving and extracting some of the shale oil and gas to a ground gas-liquid separator via oil gas passages and the export production wells.

2. The process of claim 1, wherein the gap filler is quartz sand.

3. The process of claim 1, further comprising continuing to inject highly pressurized air into the well, for oxidization reaction with asphaltenes and fixed carbon remained in the oil shale after being retorted, under high temperature, so as to generate fresh combustible gas (while driving and extracting the shale oil and gas) to the ground via the oil gas passages and the export production wells.

4. The process of claim 1, further comprising separating the exported shale oil and gas by the ground gas-liquid separator.

5. The process of claim 4, further comprising delivering the separated shale oil to a product tank for storage.

6. The process of claim 5 further comprising delivering the separated combustible gas, via the gas-liquid separator, to a gas power package for power generation.

* * * * *